US008106728B2

(12) United States Patent
Ding et al.

(10) Patent No.: US 8,106,728 B2
(45) Date of Patent: Jan. 31, 2012

(54) CIRCUIT STRUCTURE AND DESIGN STRUCTURE FOR AN OPTIONALLY SWITCHABLE ON-CHIP SLOW WAVE TRANSMISSION LINE BAND-STOP FILTER AND A METHOD OF MANUFACTURE

(75) Inventors: Hanyi Ding, Colchester, VT (US); Kwan H. Lam, Endicott, NY (US); Guoan Wang, South Burlington, VT (US); Wayne H. Woods, Jr., Burlington, VT (US)

(73) Assignee: International Business Machines Corporation, Armonk, NY (US)

( * ) Notice: Subject to any disclaimer, the term of this patent is extended or adjusted under 35 U.S.C. 154(b) by 212 days.

(21) Appl. No.: 12/424,110

(22) Filed: Apr. 15, 2009

(65) Prior Publication Data

US 2010/0265011 A1 Oct. 21, 2010

(51) Int. Cl.
*H01P 3/08* (2006.01)
*H01P 1/203* (2006.01)

(52) U.S. Cl. ..... 333/205; 333/176; 333/204

(58) Field of Classification Search ..... 333/176, 333/204, 205; 257/664, 728
See application file for complete search history.

(56) References Cited

U.S. PATENT DOCUMENTS 4,577,168 A 3/1986 Hartmann
5,065,119 A 11/1991 Jachowski
5,077,545 A 12/1991 Gopani et al.
5,191,304 A 3/1993 Jachowski
5,193,218 A * 3/1993 Shimo ..... 455/80
5,786,737 A * 7/1998 Goto ..... 333/33
6,625,470 B1 * 9/2003 Fourtet et al. ..... 455/127.4
6,727,786 B2 * 4/2004 Toncich ..... 333/219.2
7,245,194 B2 * 7/2007 Muto ..... 333/204
7,479,856 B2 * 1/2009 Asamura et al. ..... 333/204
7,589,604 B2 * 9/2009 Ninan et al. ..... 333/174
7,825,754 B2 * 11/2010 Kawai et al. ..... 333/235
2008/0059924 A1 * 3/2008 Hsu et al. ..... 716/4
2009/0315641 A1 * 12/2009 Ding et al. ..... 333/161

OTHER PUBLICATIONS

Ding et al., "On-Chip 3-D Model for Millimeter-Wave T-Lines with Gap Discontinuity in BiCMOS Technology", Microwave Conference, 2007, APMC 2007, pp. 1-4.*
Wong et al., "On-Chip 3-D Model for Millimeter-Wave T-Lines with Gap Discontinuity in BiCMOS Technology", Microwave Conference 2007, APMC 2007, pp. 1-4.*
Hsieh et al., "Slow-Wave Bandpass Filters Using Ring or Stepped-Impedance Hairpin Resonators", IEEE Transactions on Microwave Theory and Techniques, vol. 50, No. 7, Jul. 2002, pp. 1795-1800.
Cho et al., "A Millimeter-wave Micromachined Slow-Wave Bandpass Filter Using Compact Microstrip Stepped-Impedance Hairpin Resonator" (No Date Available).
Shaman et al., "Wideband Bandstop Filter With Cross-Coupling", IEEE Transactions on Microwave Theory and Techniques, vol. 55, No. 8, Aug. 2007, pp. 1780-1785.

* cited by examiner

*Primary Examiner* — Seungsook Ham
(74) *Attorney, Agent, or Firm* — Anthony Canale; Roberts Mlotkowski Safran & Cole, P.C.

(57) ABSTRACT

The present invention generally relates to a circuit structure, design structure and method of manufacturing a circuit, and more specifically to a circuit structure and design structure for an on-chip slow wave transmission line band-stop filter and a method of manufacture. A structure includes an on-chip transmission line stub comprising a conditionally floating structure structured to provide increased capacitance to the on-chip transmission line stub when the conditionally floating structure is connected to ground.

18 Claims, 12 Drawing Sheets

CIRCUIT STRUCTURE AND DESIGN STRUCTURE FOR AN OPTIONALLY SWITCHABLE ON-CHIP SLOW WAVE TRANSMISSION LINE BAND-STOP FILTER AND A METHOD OF MANUFACTURE

FIELD OF THE INVENTION

The present invention generally relates to a circuit structure, design structure and method of manufacturing a circuit, and more specifically to a circuit structure and design structure for an on-chip slow wave transmission line band-stop filter and a method of manufacture.

BACKGROUND

In signal processing, a band-stop filter or band-rejection filter is a filter that passes most frequencies unaltered, but attenuates those in a specific range to very low levels. A notch filter is a band-stop filter with a narrow stopband (high Q factor). Other names for a notch filter may include "band limit filter", "T-notch filter", "band-elimination filter", and "band-reject filter".

An LC circuit is a variety of a resonant circuit or tuned circuit and includes an inductor, represented by the letter L, and a capacitor, represented by the letter C. When connected together, an electric current can alternate between them at the circuit's resonant frequency. LC circuits are often used as filters. For example, three-element filters can have a "T" topology, wherein a low-pass, high-pass, band-pass, or band-stop characteristic is possible. The components of the filter can be chosen (e.g., symmetrical or not), depending on the required frequency characteristics of the filter.

LC circuits may be used for generating signals at a particular frequency, or picking out a signal at a particular frequency from a more complex signal. LC circuits are key components in many applications such as oscillators, filters, tuners and frequency mixers. For example, a microstrip circuit uses a thin flat conductor that is parallel to a ground plane. The microstrip can be made by having, for example, a wide strip of copper on one side of a printed circuit board (PCB) or ceramic substrate while the other side is a continuous ground plane. The width of the strip, the thickness of the insulating layer (PCB or ceramic) and/or the dielectric constant of the insulating layer determine the characteristic impedance of the microstrip.

Band-stop or notch filters may use transmission lines (t-lines) orthogonal to a signal path, which cause cancelation at certain frequencies that match resonant points in the t-line connected to the signal path. One end of the t-line is open and the total length from the signal path connection to the open end of the t-line stub and back to the signal connection (twice the stub length) causes a 180 degree phase shift and causes cancellation at particular frequencies.

However, conventional filters, e.g., t-line stub filters, can occupy large portions of a semiconductor, which, for example, prevent these portions of the semiconductor from being utilized for other purposes and/or increases the overall size of the device, which increases costs. For example, conventional filters may use series/parallel LC resonance using on-chip inductor and capacitor or a traditional open transmission line. However, each of these approaches require a large amount of semiconductor space.

Accordingly, there exists a need in the art to overcome the deficiencies and limitations described hereinabove.

SUMMARY

In a first aspect of the invention, a structure comprises an on-chip transmission line stub including a conditionally floating structure structured to provide increased capacitance to the on-chip transmission line stub when the conditionally floating structure is connected to ground.

In an additional aspect of the invention, a method comprises forming in a substrate an on-chip transmission line stub comprising forming a conditionally floating structure operable to provide increased capacitance to the on-chip transmission line stub when the conditionally floating structure is connected to ground.

In an additional aspect of the invention, a design structure is embodied in a machine readable medium for designing, manufacturing, or testing a design. The design structure comprises an on-chip transmission line stub including a conditionally floating structure operable to provide increased capacitance to the on-chip transmission line stub when the conditionally floating structure is connected to ground.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

DETAILED DESCRIPTION

The present invention generally relates to a circuit structure, design structure and method of manufacturing a circuit, and more specifically to a circuit structure and design structure for an on-chip slow wave transmission line band-stop filter and a method of manufacture. The present invention comprises a very compact, on-chip, t-line band-stop filter design. In embodiments, the on-chip t-line stub band-stop filter is operable at millimeter wave (MMW) frequencies.

Additionally, in embodiments, the slow-wave t-line stub band-stop filter may be connected to a switching device (e.g., an on-chip FET or an on-chip diode) and may be toggled between, e.g., a pass state and a band-stop state or a first band-stop state and a second band-stop state. In accordance with aspects of the invention, to facilitate switching, the structure provides shielding for the central conductor (e.g., conditional grounded or floating) well from the ground return paths in the floating state.

By implementing the present invention, the area on a semiconductor chip needed to accommodate the very compact slow wave t-line stub design can be reduced. That is, a dramatic reduction of the size required for the t-line stub band-stop filter compared to that of the conventional t-line band-stop/notch filters is possible with the present invention. More specifically, in embodiments, specific structures are used to increase the capacitance of a device and/or reduce the size of the device. Reducing the area needed to accommodate the slow wave t-line stub circuit design will, for example, reduce costs for manufacture. Furthermore, implementing the present invention provides both an excellent slow-wave effect and the option of conditional switching given switches with adequate on/off state performance.

In embodiments, the device or circuit may use conventional metal layers to provide a very large capacitance coupling while also shielding the "control" conductor from ground return structures. The design provides a very good slow-wave structure (reducing the propagation delay of a structure by increasing the capacitance and/or inductance) to increase the propagation delay through the device proportional to: sqrt(LC). By using the novel slow-wave structure of the present invention as the t-line stub, a very compact band-stop filter can be constructed that is useful in millimeter wave (MMW) circuit designs.

Figure 1:
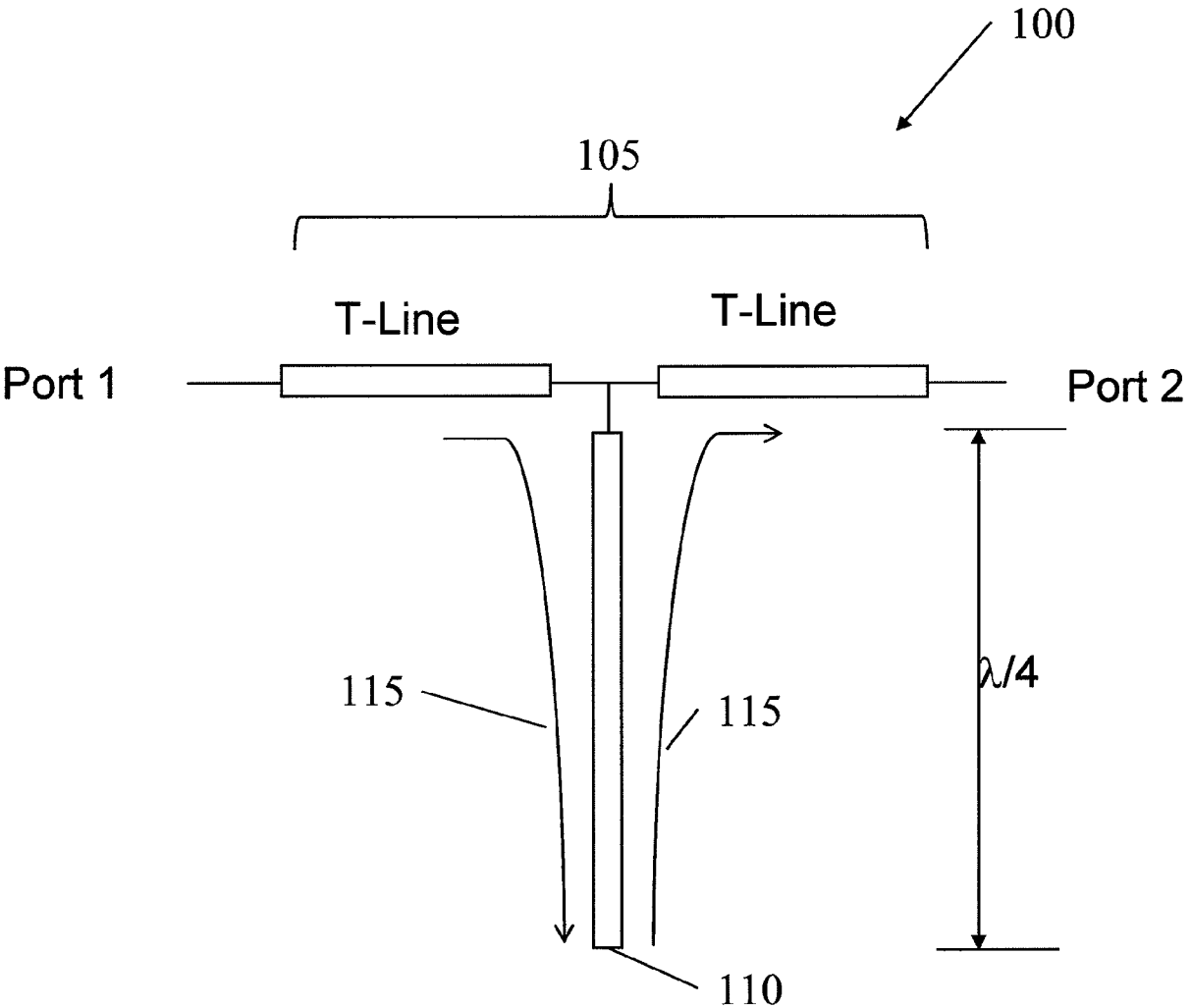
FIG. 1 shows a schematic representation of a band stop filter using a transmission line stub.

FIG. 1 illustrates a schematic representation 100 for a band stop filter 105 using an open t-line stub 110. The band stop filter 105 is arranged in a transmission line between an input, e.g., Port 1, and an output, e.g., Port 2. In accordance with the operation of a band stop filter 105 using a transmission line stub 110, when the length of the open t-line stub 110 is one-quarter the length of a particular wavelength λ, the band stop filter will filter a frequency corresponding to that particular wavelength. More specifically, in passing a signal from Port 1 to Port 2, the signal will traverse the open stub 110 along path 115, which causes canceling of the frequency corresponding to λ. More specifically, one end of the t-line stub 110 is open and the total length from the signal path connection-to the open end of the t-line stub 110 and back to the signal connection (twice the stub length) causes a 180 degree phase shift and causes cancellation at particular frequencies.

Figure 2:
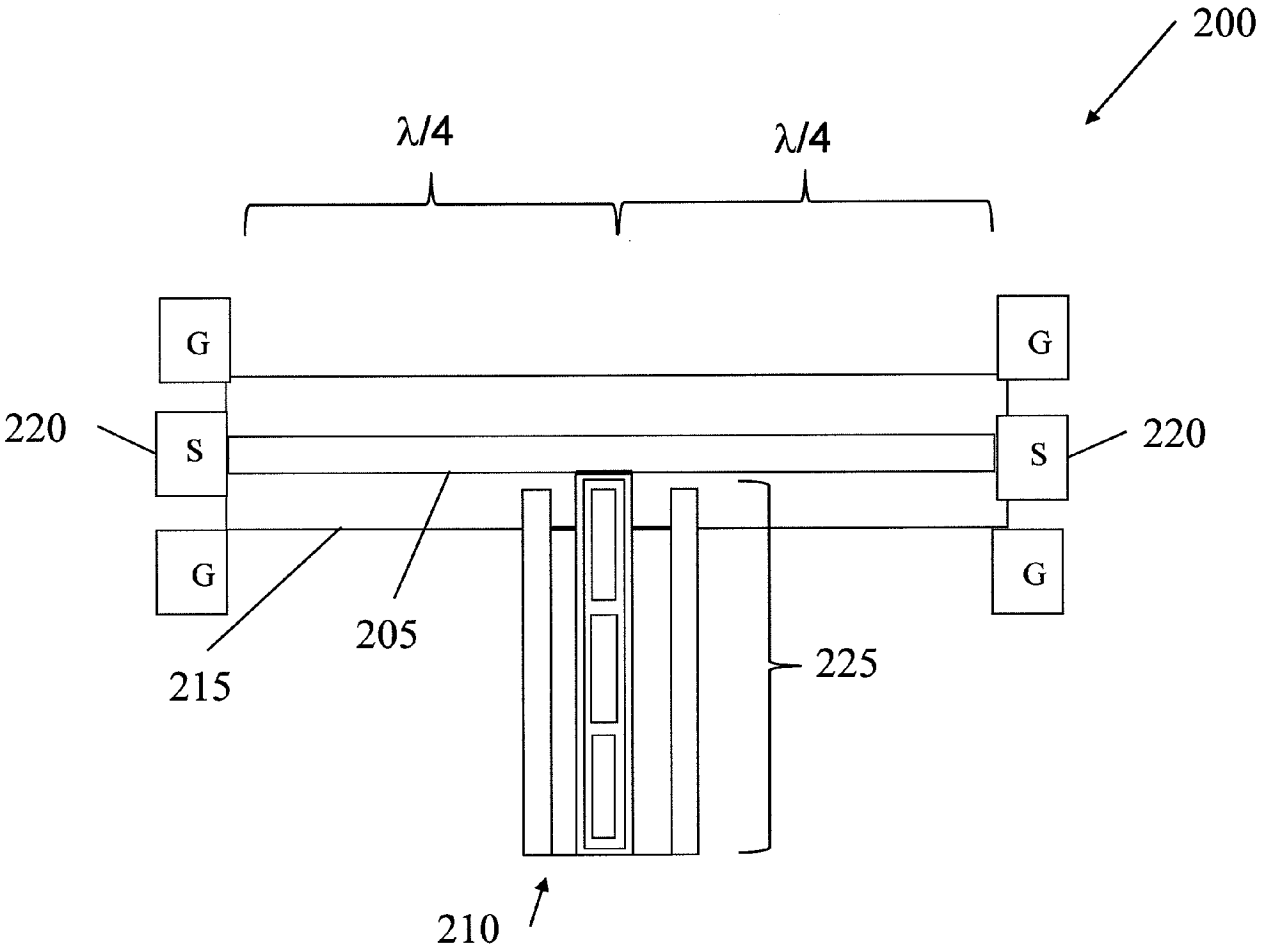
FIG. 2 shows a layout view of an exemplary slow-wave coplanar waveguide structure in accordance with aspects of the invention.

FIG. 2 illustrates an exemplary slow-wave coplanar waveguide structure layout 200 in accordance with aspects of the invention. The structure layout 200 of FIG. 2 may be used, for example, for tests and/or applications. As shown in FIG. 2, signal pads 220 are formed in electrical contact with a metal layer 205. Metal layer 205 is a transmission line formed on strip 215, which may be, for example, a fifty ohm microstrip. Further, as shown in FIG. 2, a slow wave coplanar transmission line (t-line) stub 210 is provided, the details of which are discussed more fully below. The length 225 of the t-line stub 210 may be determined based, for example, upon the desired stop band frequency of the resulting band-stop filter, as discussed further below. In embodiments, the length 225 of the t-line stub 210 may be λ/4, with other lengths contemplated by the invention. Additionally, in embodiments, as shown in FIG. 2, the length of the transmission line portions from either of the signal pads 220 to the t-line stub 210 may be λ/4.

In embodiments, the slow-wave coplanar waveguide structure of the t-line stub 210 may be formed with a length 225 of λ/4, similar to a conventional t-line stub, in order to cancel out a frequency corresponding to λ, as discussed above. However, as discussed further below, the invention contemplates that the slow-wave coplanar waveguide structure of the t-line stub 210 may be formed with a length 225 greater than λ/4.

Figure 3A:
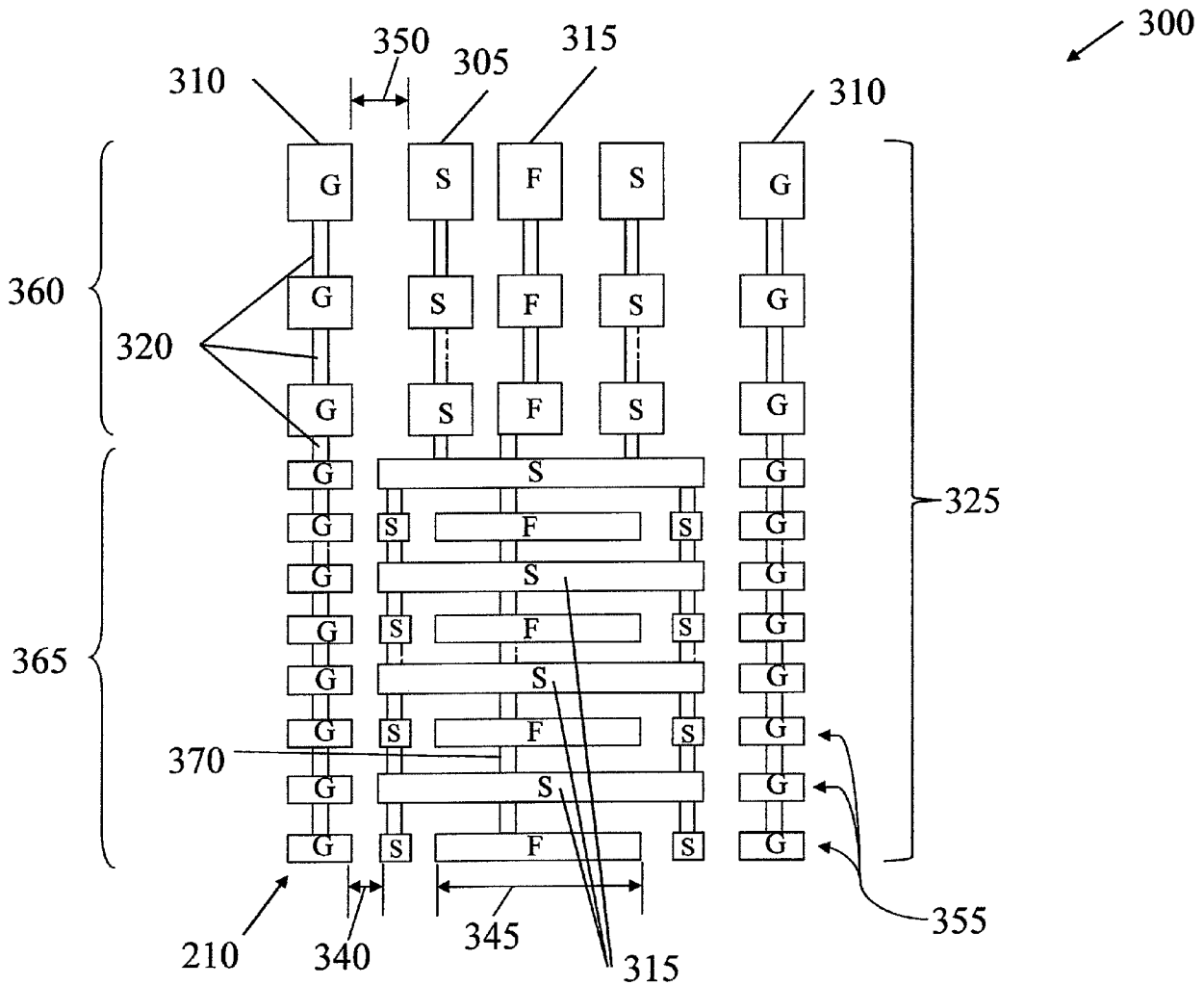
FIG. 3A shows a cross section view of an exemplary slow-wave coplanar waveguide structure in accordance with aspects of the invention.

FIG. 3A illustrates a cross section view 300 of an exemplary slow-wave coplanar waveguide structure in accordance with aspects of the invention. More specifically, FIG. 3A illustrates an exemplary slow-wave coplanar waveguide structure that may be used as a t-line stub 21 0 (as shown in FIG. 2). As shown in FIG. 3A, the exemplary t-line stub 210 includes a plurality of metal wiring layers 355 (e.g., eleven metal wiring layers 355 in this exemplary structure) formed in a substrate (not shown). These metal wiring layers 355 may be formed using conventional BEOL formation processes, for example, conventional lithographic processes, conventional damascene processes and conventional etching processes (e.g., RIE) well understood by those having ordinary skill in the art. As such, a description of the lithographic processes, the etching processes and the damascene processes are not necessary for a person of ordinary skill in the art to practice the present invention.

As shown in FIG. 3A, the exemplary t-line stub 210 includes grounded structures 310. The grounded structures 310 (with elements of the grounded structures labeled "G") each comprise portions (e.g., a first portion) of each metal wiring layer 355, which are electrically connected with one another using a plurality of vias 320 (or via array).

Figure 7:
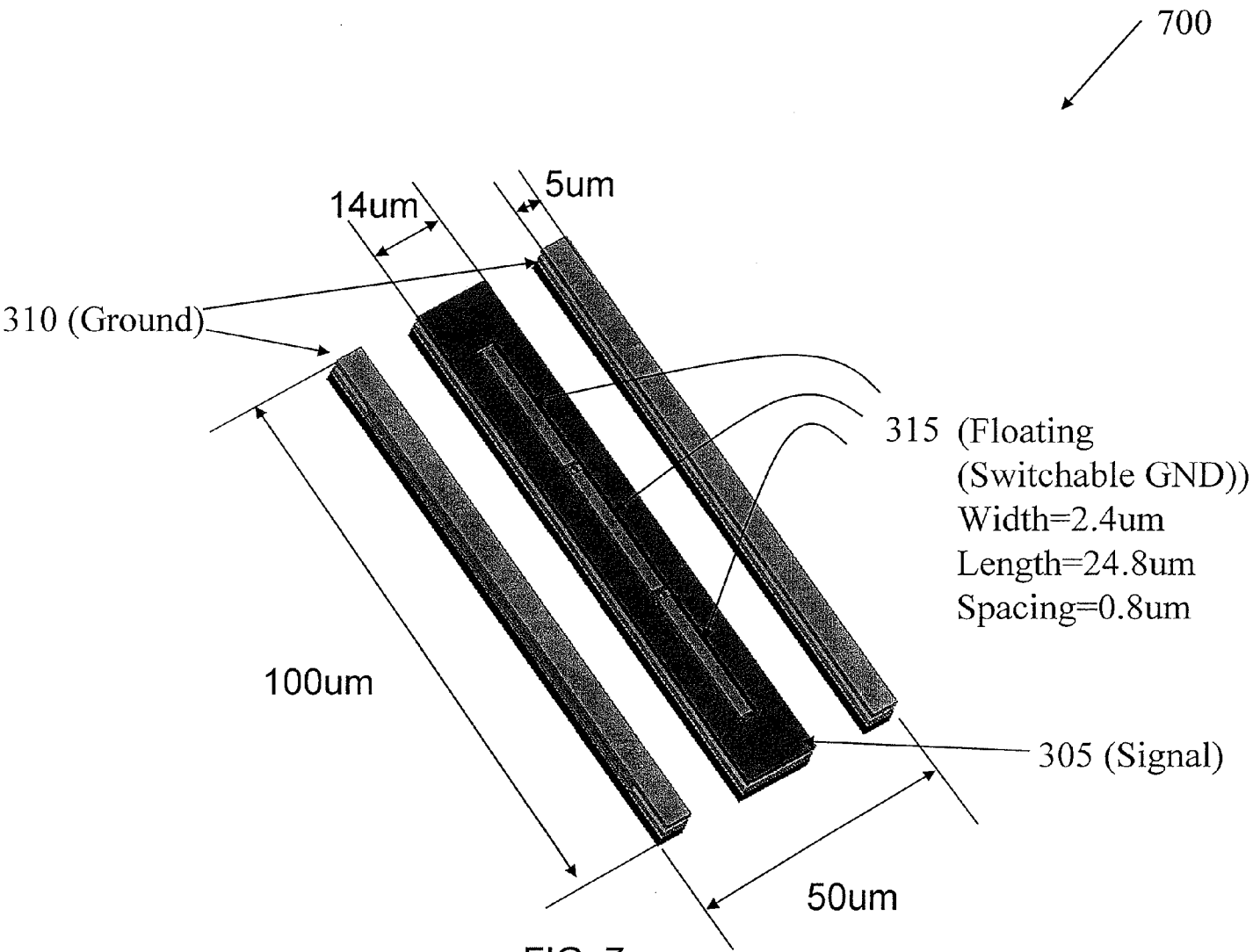
FIG. 7 shows a perspective view of an exemplary slow-wave coplanar waveguide structure in accordance with aspects of the invention.

Within the grounded structures 310 is a signal structure 305 (with elements of the signal structure labeled "S") comprising portions (e.g., second portions) of the top three metal wiring layers 355 in an upper section 360 of the t-line stub 210 and alternating wider layers (e.g., third portions) and thinner portions (e.g., fourth portions) of metal wiring layers 355 in a lower section 365 of the t-line stub 210. The signal structure 305 additionally includes metal vias 320, which electrically connect the elements S of the signal structure 305. While the signal structure 310 is shown in the exemplary cross-section of FIG. 3A as including, for example, two signal elements S on each metal wiring layer 355 of the upper section 360 and two signal elements S on alternating metal wiring layers 355 of the lower section 365, the invention contemplates that these respective two elements on each metal wiring layer 355 may be a single ring structure element formed around the conditionally floating structure 315 (for example, as shown in FIG. 7 and discussed further below).

Furthermore, as shown in the exemplary cross-section of FIG. 3A, the t-line stub includes the conditionally floating structure 315 (with elements of the conditionally floating structure labeled "F"), which includes portions (e.g., fifth portions)of the top three metal wiring layers 355 in an upper section 360 of the t-line stub 210 within the signal structure 305 and alternating wider layers (e.g., sixth portions) of the metal wiring layers 355 in a lower section 365 of the t-line stub 210. The floating structure 315 additionally includes vias 370, which electrically connect the conditionally floating elements F of the conditionally floating structure 315, such that the metal wiring layers 355 in the upper section 360 of the floating structure 315 are connected to the metal wiring layers 355 of the lower section 365 of the conditionally floating structure 315 with metal vias 370. As should be understood by those of ordinary skill in the art, while vias 370 are illustrated as passing through the signal elements S, vias 370 do not electrically connect the conditionally floating elements F with the signal elements S. As shown in FIG. 3A, the structure provides shielding for the central conductor (e.g., conditional grounded or floating) from the ground return paths in the floating state.

While the exemplary slow-wave coplanar waveguide structure of FIG. 3A is shown having three thicker metal wiring layers 355 in the upper section 360 and eight thinner metal wiring layers 355 in the lower section 365, the invention contemplates that the device may be formed with more or less thicker metal wiring layers 355 in the upper section 360 and more or less thinner wiring layers 355 in the lower section 365. Moreover, while the exemplary slow-wave coplanar waveguide structure of FIG. 3A is shown having thicker metal wiring layers 355 in the upper section 360 of uniform thickness and thinner metal wiring layers 355 in the lower section 365 of uniform thickness, the invention contemplates that the thicker metal wiring layers 355 in the upper section 360 may have different thicknesses as compared to one another and the thinner metal wiring layers 355 in the lower section 365 may have different thicknesses as compared to one another.

As shown in FIG. 3A, in the upper section 360 of the t-line stub 210, the grounded structure 310 may be spaced from the signal structure 305 by a spacing 350. Moreover, in the lower section 365 of the t-line stub 210, the grounded structure 310 may be spaced from the signal structure 305 by a spacing 340, which, in embodiments, may be smaller than spacing 350. However, the invention contemplates that in embodiments, the spacings 340 and 350 may be the same spacing. Additionally, the conditionally floating structure 315 in the lower section 365 has a width 345, which is wider than the portions of the conditionally floating structure 315 in the upper section 360. In embodiments, the spacings 350 and 340 and the width 345 may be varied to tune the coplanar waveguide structure 210 to provide for filtering of particular frequencies in accordance with aspects of the invention.

Figure 3B:
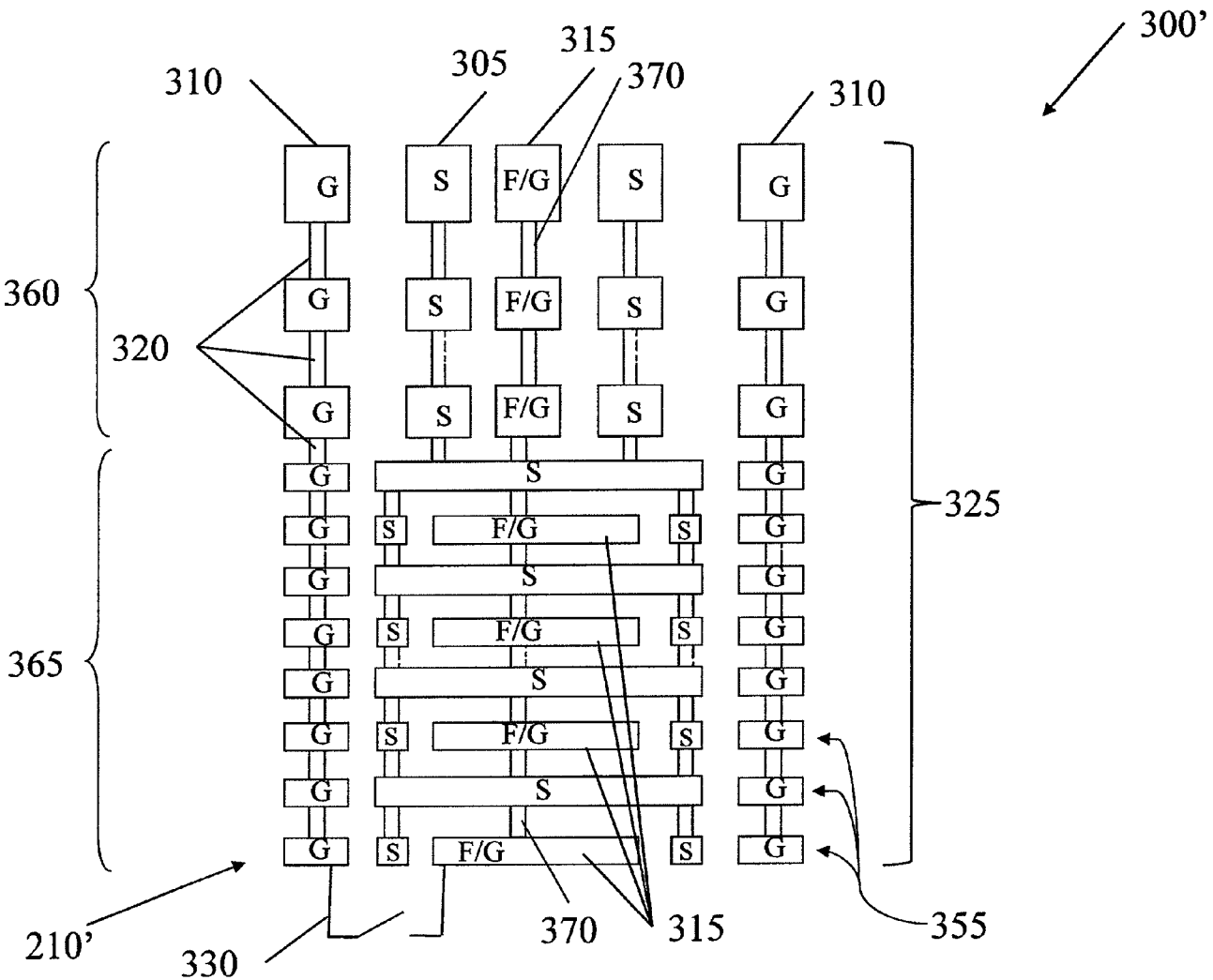
FIG. 3B shows a cross section view of an exemplary slow-wave coplanar waveguide structure with a switch in accordance with aspects of the invention.

FIG. 3B illustrates a cross section view 300' of an exemplary slow-wave coplanar waveguide structure 210' with a switch 330 in accordance with aspects of the invention. The switch 330 is operable to selectively switch the conditionally floating structure 315 to a grounded structure. That is, by closing the switch 330, the grounded structure 310 is in electrical contact with the conditionally floating structure 315, such that the conditionally floating structure 315 is grounded. In embodiments, the switch 330 may be, for example, a field effect transistor (FET) or an on-chip diode, amongst other possible switches.

In accordance with aspects of the invention, when the conditionally floating structure 315 is grounded, the capacitance between the signal structure 305 and the ground node (because the conditionally floating structure 315 is now grounded) becomes much larger. As can be observed in FIG. 3B, the upper section 360 of the exemplary slow-wave coplanar waveguide structure 210' has thicker metal wiring layers 355 with less surface area between the signal structure 305 and the conditionally floating structure 315. In contrast, in the lower section 365 of the exemplary slow-wave coplanar waveguide structure 210', the coplanar signal elements S of the signal structure 305 and the conditionally floating elements F/G of the conditionally floating structure 315 provide a large amount of surface area there between, which provides a large amount of capacitance when the conditionally floating structure 315 is connected (e.g., by a switch) to ground.

As a result of the increased capacitance, the frequency of the stop band is lowered in accordance with 1/sqrt(LC). That is, the capacitance is increased due to the conditionally floating elements F/G being switched to ground. Thus, in accordance with aspects of the invention, in embodiments, implementing the exemplary slow-wave coplanar waveguide structure 210' with a switch 330 allows the stop band frequency to be switched between a higher frequency when the conditionally floating elements F/G remain floating to a lower stop band frequency when the conditionally floating elements F/G are grounded.

Figure 4:
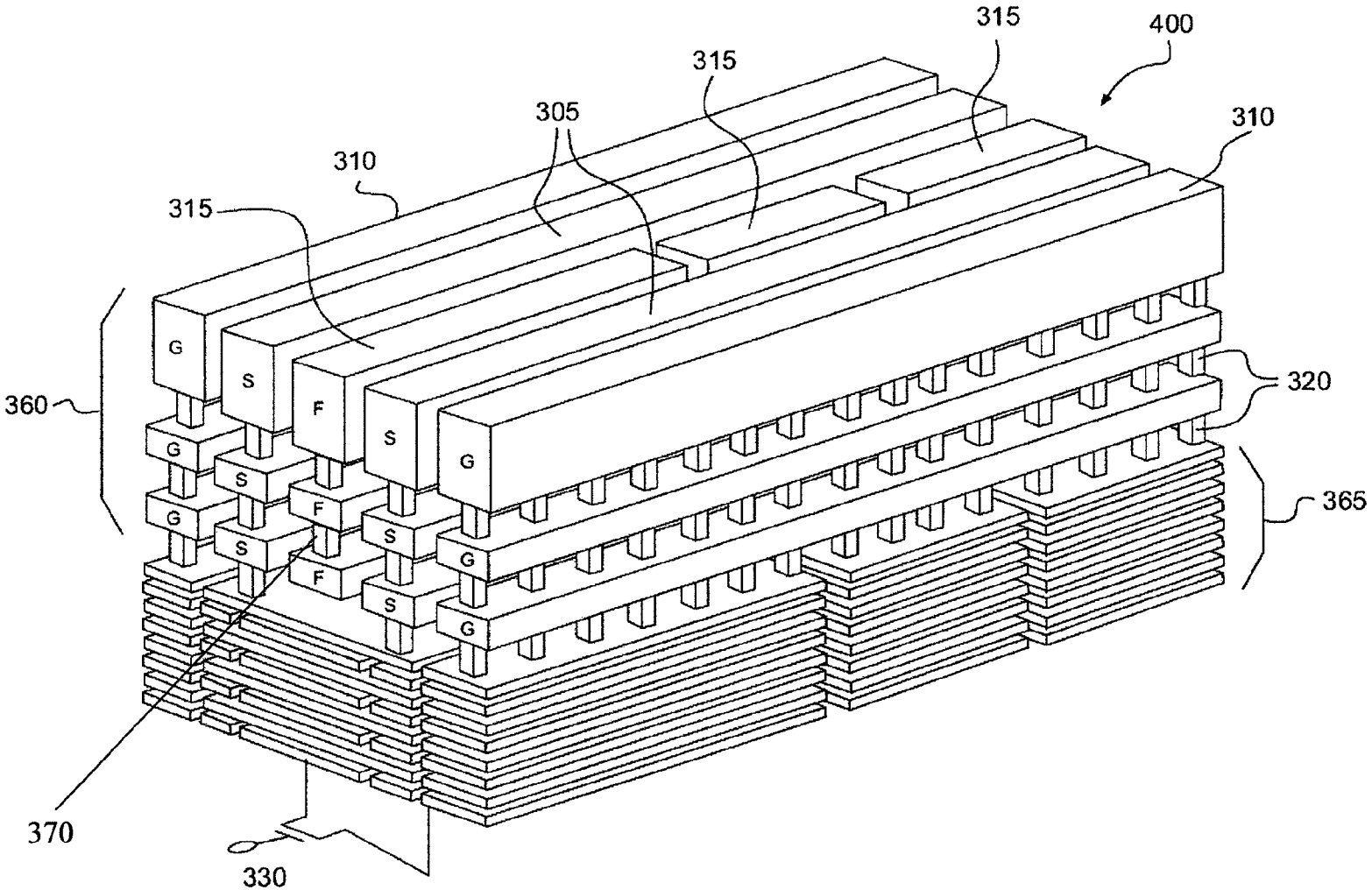
FIG. 4 shows a perspective view of an exemplary slow-wave coplanar waveguide structure in accordance with aspects of the invention.

FIG. 4 shows a perspective view of an exemplary slow-wave coplanar waveguide structure 400 in accordance with aspects of the invention. As shown in FIG. 4, in embodiments, the conditionally floating structure 315 may comprise three sections, which are separated from one another so that they do not affect the inductance of the device. However, the three sections of the conditionally floating structure 315 are all connected to a single electrical node. Moreover, while not shown in FIG. 4, the three sections of the conditionally floating structure 315 are connected with metal vias 370, in embodiments, to either a common ground node or switches 330, e.g., FETs, that can be switched to connect the three sections of the conditionally floating structure 315 to ground. While the exemplary slow-wave coplanar waveguide structure 400 includes a conditionally floating structure 315 having three sections, the invention contemplates that any number of sections may be used to control the inductance of the device so that the inductance does not significantly affect the resulting band stop frequency.

Figure 5:
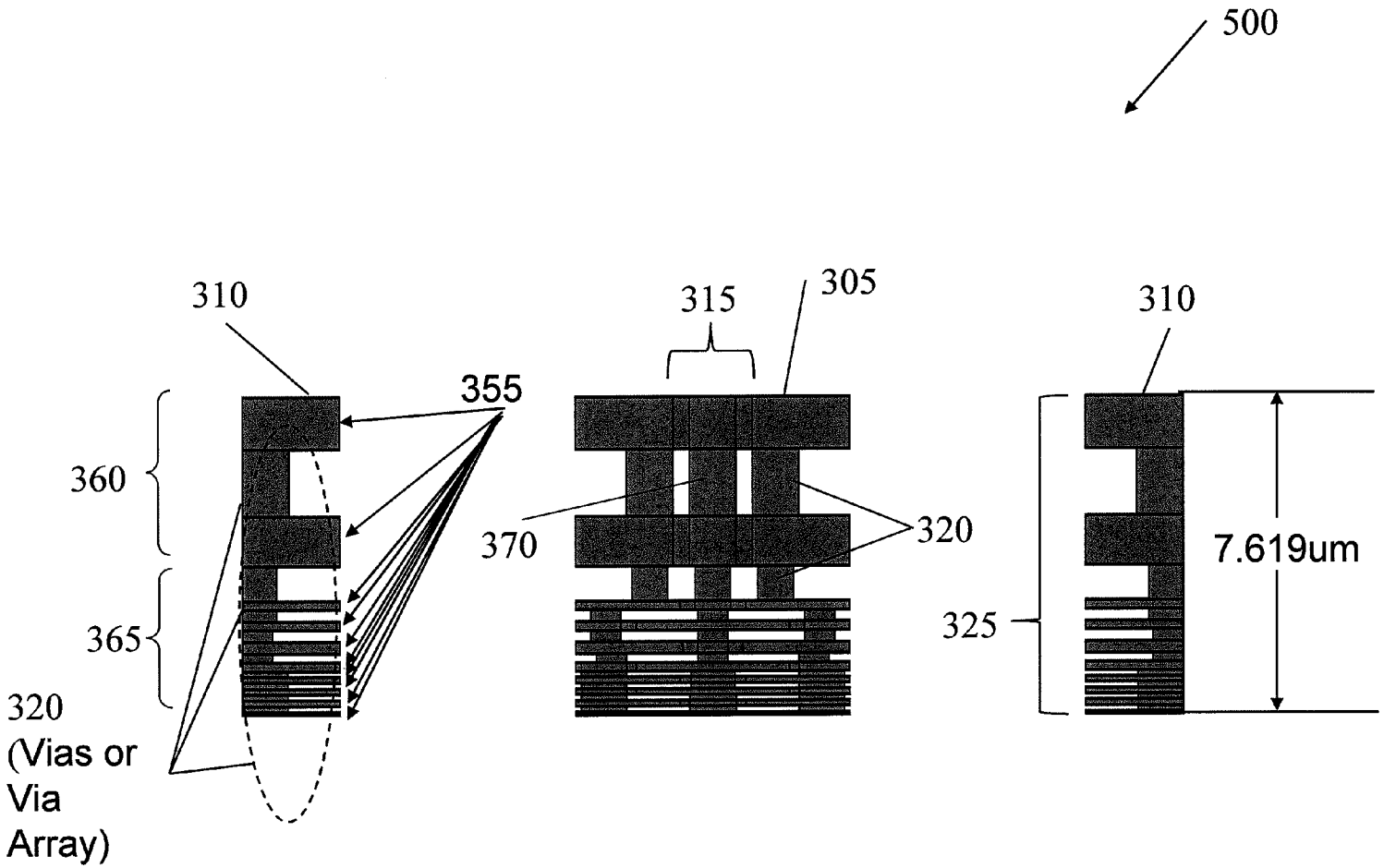
FIG. 5 shows a cross section view of an exemplary slow-wave coplanar waveguide structure in accordance with aspects of the invention.

FIG. 5 shows a cross section view of an exemplary slow-wave coplanar waveguide structure 500 in accordance with aspects of the invention. As shown in FIG. 5, the signal structure 305 is formed between two grounded structures 310. Additionally, the conditionally floating structure 315 is formed within the signal structure 305. The metal wiring layers 355 of the grounded structures 310 are connected by vias or a via array 320. Additionally, the metal wiring layers 355 of the signal structure 305 are connected by metal vias or a via array 320. Furthermore, the metal wiring layers 355 of the conditionally floating structure 315 are connected by metal vias or a via array 370.

As shown in FIG. 5, with this exemplary slow-wave coplanar waveguide structure 500, the height 325 of the slow-wave coplanar waveguide structure 500 is 7.619 μm. However, the invention contemplates that other heights 325 may be used depending, for example, upon the desired stop band frequency (or frequencies) of the slow-wave coplanar waveguide structure 500. Moreover, in accordance with aspects of the invention, as shown in FIG. 5, with this exemplary embodiment, the slow wave coplanar waveguide structure 500 includes two thicker metal wiring layers 355 in the upper section 360 and eight thinner metal wiring layers 355 in the lower section 365 of varying thicknesses.

Figure 6:
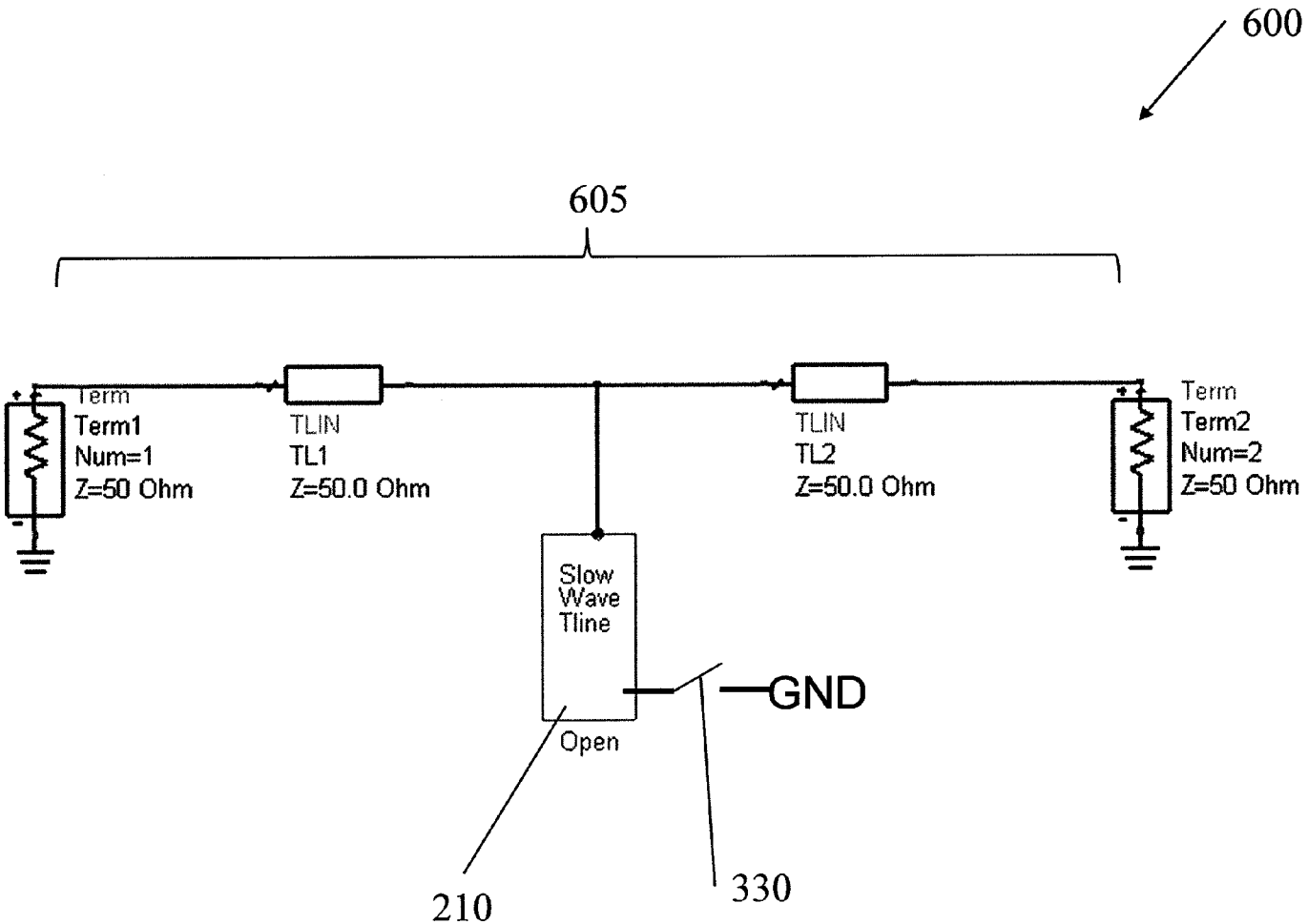
FIG. 6 shows an exemplary switchable band-stop filter circuit in accordance with aspects of the invention.

FIG. 6 shows an exemplary switchable band-stop filter circuit 600 in accordance with aspects of the invention. As shown in FIG. 6, a slow-wave coplanar waveguide t-line stub 210 is connected in a transmission line 605, which may be a conventional fifty-ohm microstrip. Additionally, as shown in FIG. 6, the exemplary switchable band-stop filter circuit 600 includes a switch 330. In accordance with aspects of the invention, the switch 330 is operable to connect the conditionally floating structure (not shown) of the slow-wave coplanar waveguide t-line stub 210 to ground. As explained above, when the conditionally floating structure (not shown) of the slow-wave coplanar waveguide t-line stub 210 is connected to ground, the capacitance of the slow-wave coplanar waveguide t-line stub 210 is increased, which lowers the band stop frequency of the slow-wave coplanar waveguide t-line stub 210.

FIG. 7 shows a perspective view of an exemplary slow-wave coplanar waveguide structure 700 in accordance with aspects of the invention. As shown in FIG. 7, the signal structure 305 is a ring structure formed around the conditionally floating structure 315. Moreover, the conditionally floating structure 315 is formed of three sections so as to reduce any impact of the inductance on the band stop frequency. The grounded structures 310 are formed spaced from the signal structure 305. As can be discerned from FIG. 7, with this exemplary slow-wave coplanar waveguide structure 700, the spacing between the grounded structure 310 and the signal structure is the same spacing (e.g., 13 μm) for both the upper and lower sections of the t-line stub 210. Moreover, with this exemplary slow-wave coplanar waveguide structure 700, the width of the conditionally floating structure 315 is 2.4 μm and each section of the conditionally floating structure 315 has a length of approximately 24.8 μm and a spacing there between of approximately 0.8 μm. While the exemplary slow-wave coplanar waveguide structure 700 includes a conditionally floating structure 315 having three sections of uniform length and spacing, the invention contemplates that, in embodiments, the sections of the conditionally floating structure 315 may have different lengths and/or different spacings there between.

In accordance with aspects of the invention, when the conditionally floating structure 315 is connected to ground via a switch (not shown), e.g., a FET, there is a small resistance from the conditionally floating structure 315 to ground. Thus, as described above, the capacitance to ground of the slow-wave coplanar waveguide structure 700 is increased and the band stop frequency is lowered. When the conditionally floating structure 315 is not connected to ground via a switch (not shown), i.e., remains floating, there may still be some electrical connection to ground (for example, parasitic capacitances), albeit a much smaller connection to ground as compared to when the switch (not shown) directly connects the conditionally floating structure 315 to ground. Thus, when the conditional floating structure 315 remains floating, the increased capacitance is not realized and the band stop frequency is higher.

Figure 8:
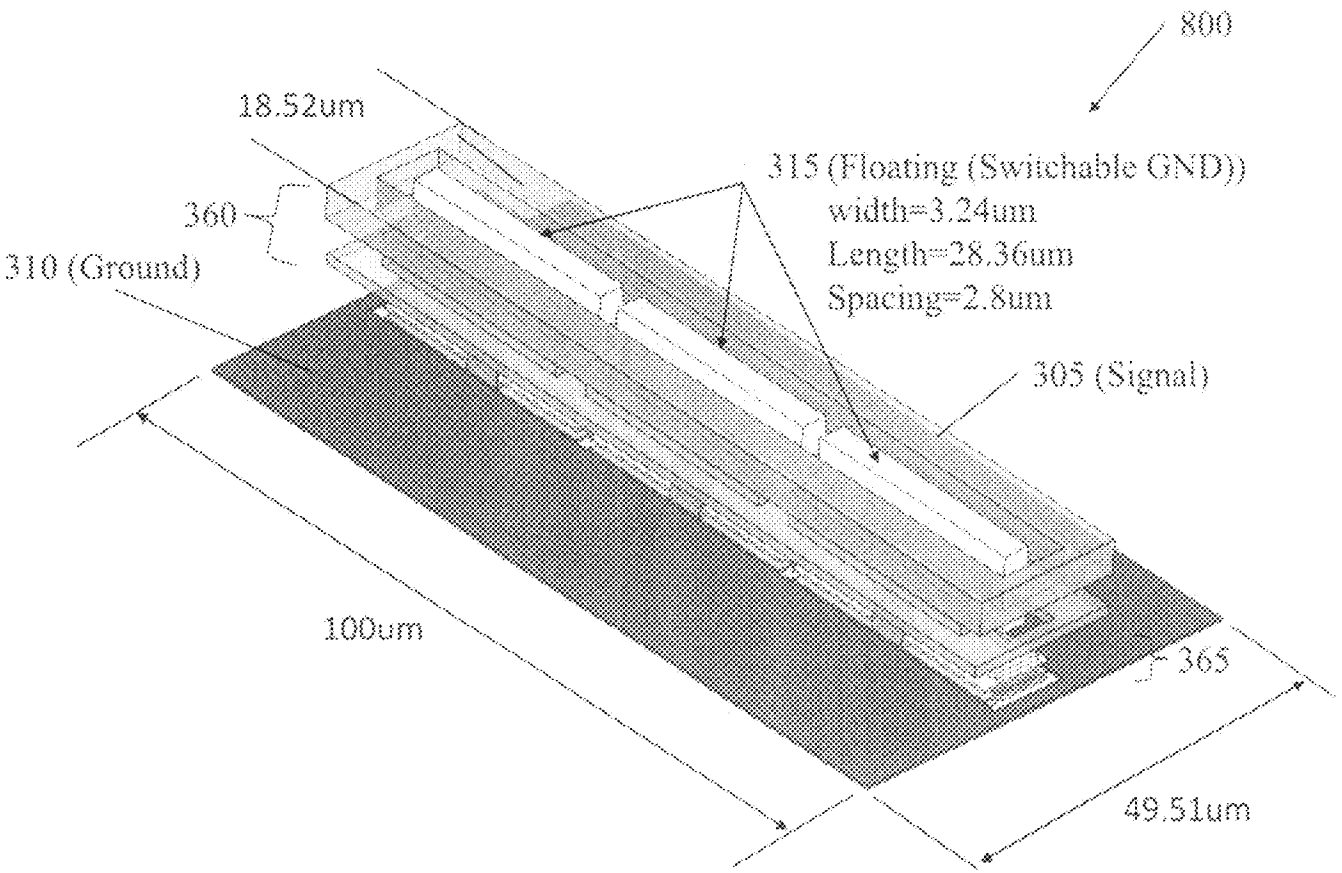
FIG. 8 shows a perspective view of an exemplary slow-wave microstrip structure in accordance with aspects of the invention.

FIG. 8 shows a perspective view of an exemplary slow-wave microstrip structure 800 in accordance with aspects of the invention. As shown in FIG. 8, with this exemplary slow-wave coplanar waveguide structure 800, the grounded structure 310 is formed as a ring structure around the signal structure 305, and the signal structure 305 is formed as a ring structure around the conditionally floating structure 315. Moreover, in contrast to the exemplary slow-wave coplanar waveguide structure 700 of FIG. 7, with the exemplary slow-wave microstrip structure 800 of FIG. 8, the grounded structure 310 is present only on the lowest metal layer. With this exemplary slow-wave microstrip structure 800, the width of the conditionally floating structure 315 is approximately 3.24 μm and each section of the conditionally floating structure 315 has a length of approximately 28.36 μm and a spacing there between of approximately 2.8 μm, with other dimensions contemplated by the invention.

Figure 9:
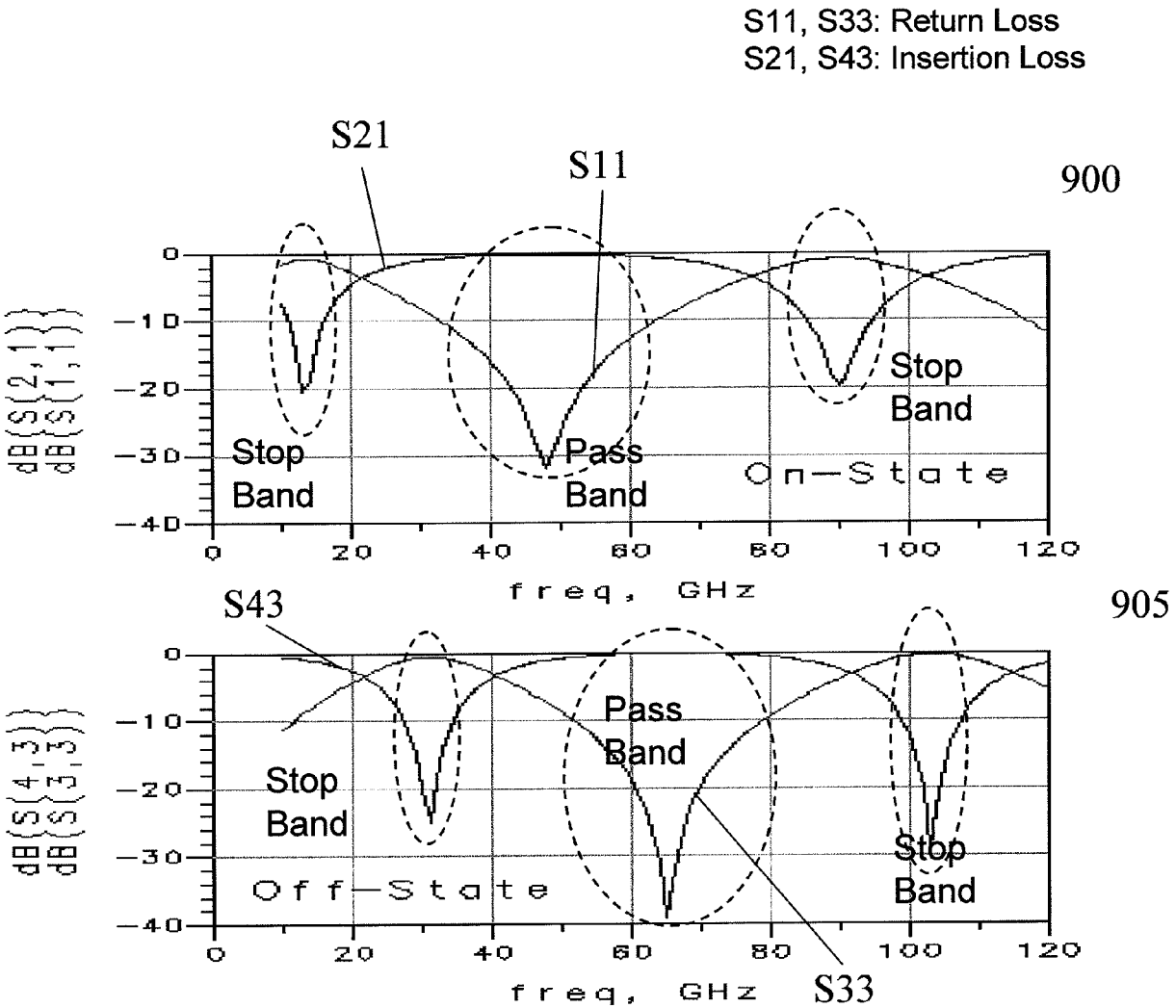
FIG. 9 shows on-state and off-state gain versus frequency plots for an exemplary coplanar waveguide structure with a FET switch in accordance with aspects of the invention.

FIG. 9 shows on-state 900 and off-state 905 gain versus frequency plots for an exemplary coplanar waveguide structure with a FET switch in accordance with aspects of the invention. More specifically, FIG. 9 shows on-state 900 and off-state 905 gain versus frequency plots for an exemplary coplanar waveguide structure with a 2.5 Ohm on-state FET resistance and a 40 fF off-state FET capacitance. As shown in FIG. 9, each plot includes an insertion loss (S21 and S43), which indicates how much signal passes from one side of the transmission line to the other, and a return loss (S11 and S33), which indicates how much signal is reflected back. As can be observed in FIG. 9, the insertion loss (S21 or S43) is inversely related to the respective return loss (S11 or S33) for each plot.

As shown in the on-state plot 900 of FIG. 9, with the switch on (and the conditionally floating structure 315 connected to ground), the stop band frequency is approximately 12 GHz and the pass band is approximately 48 GHz. In contrast, as shown in the off-state plot 905 of FIG. 9, with the switch off (and the conditionally floating structure 315 remaining floating) for the same slow-wave coplanar waveguide structure, the stop band frequency is approximately 30 GHz and the pass band is approximately 65 GHz. Thus, in accordance with aspects of the invention, the slow-wave coplanar waveguide structure may operate as a small-size conditional/switchable/controllable MMW band-stop filter. As should be understood by those of ordinary skill in the art, the slow-wave coplanar waveguide t-line stub may provide more than one stop band frequency. Thus, as shown in FIG. 9, with the switch on, an additional stop band frequency is approximately 90 GHz and with the switch off for the same slow-wave coplanar waveguide structure, an additional stop band frequency is approximately 103 GHz.

As can be observed in FIG. 9, in accordance with aspects of the invention, the switchable coplanar waveguide structure is operable to switch the band stop frequency by connecting the conditionally floating structure to ground. As should be understood by those of skill in the art, while the on-state 900 and off-state 905 gain versus frequency plots for the exemplary coplanar waveguide structure with a FET switch has an on-state stop band frequency of approximately 12 GHz and an off-state stop band frequency of approximately 30 GHz, the invention contemplates that other on-state and off-state stop band frequencies may be achieved by varying the dimensions of the coplanar waveguide structure and/or the coupling capacitance of the coplanar waveguide structure. Thus, in embodiments, the coplanar waveguide structure may be specifically designed to operate at a desired target band stop frequency. For example, a designer may select the desired center frequency of the band-stop filter (in the middle of the stop band) and then determine the length of the slow-wave element (with the conditionally floating conductor connected directly to ground (grounded)) based on the desired center frequency of the band-stop filter.

Additionally, in embodiments, the conditionally floating section 315 may be grounded without using a switch, such that the conditionally floating section 315 is grounded. In accordance with aspects of the invention, when the conditionally floating section 315 is always grounded, due to the added capacitance of the conditionally floating section 315 (which is grounded), the length of the t-line stub to achieve a particular stop band frequency will be much less as compared to a conventional t-line stub length necessary to achieve the same stop band frequency. That is, with the conventional t-line stub, the length of the t-line stub is $\lambda/4$, wherein $\lambda$ corresponds to the desired stop band frequency. However, in accordance with aspects of the invention, with the slow-wave coplanar waveguide structure, the length of the t-line stub having the slow-wave coplanar waveguide structure may be less than $\lambda/4$, while still achieving a stop band frequency corresponding to $\lambda$. Thus, by using a t-line stub having the slow-wave coplanar waveguide structure of the present invention, the size of the device may be reduced as compared to a conventional t-line stub. For example, the results of FIG. 9 were obtained with a slow-wave coplanar waveguide t-line stub having a length of approximately 750 μm. In contrast, to achieve the same stop band frequency using a conventional t-line stub would require a t-line stub length of approximately 7,500 μm (an increase in length of about one thousand percent). Thus, in embodiments, the slow-wave coplanar waveguide t-line structure operates as a slow MMW wave band-stop filter with a smaller size compared to a conventional structure.

Figure 10:
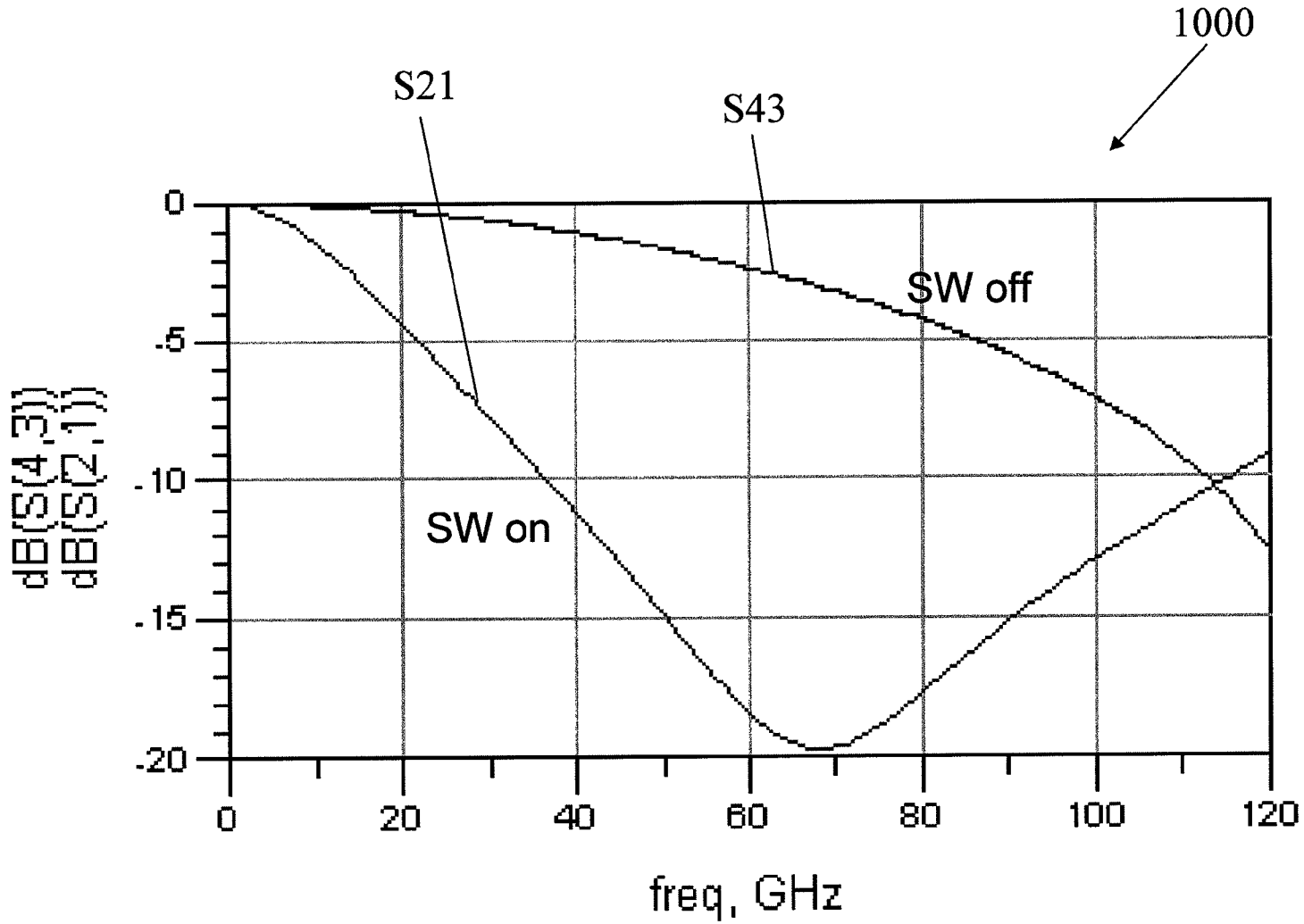
FIG. 10 shows a gain versus frequency plot for an exemplary coplanar waveguide structure in accordance with aspects of the invention.

FIG. 10 shows a gain versus frequency plot 1000 for an exemplary coplanar waveguide structure in accordance with aspects of the invention. As shown in FIG. 10, the plot 1000 illustrates the insertion loss S21 with the switch on (and the conditionally floating structure 315 connected to ground) and the insertions loss S43 with the switch off (and the conditionally floating structure 315 remaining floating). As can be observed in FIG. 10, with the switch on, the stop band frequency is approximately 68 GHz and with the switch off, the band stop frequency is much higher (interpolated as approximately 130 GHz). Thus, in embodiments, with a switchable coplanar waveguide t-line stub, the band stop frequency may be switched between a higher band stop frequency (switch off; conditionally floating structure remains floating) and a lower band stop frequency (switch on; conditionally floating structure grounded). Moreover, as discussed above, the coplanar waveguide t-line stub may be tailored to achieve particular stop band frequencies, for example, by varying the dimensions of the coplanar waveguide structure and/or the coupling capacitance of the coplanar waveguide structure.

Design Flow

Figure 11:
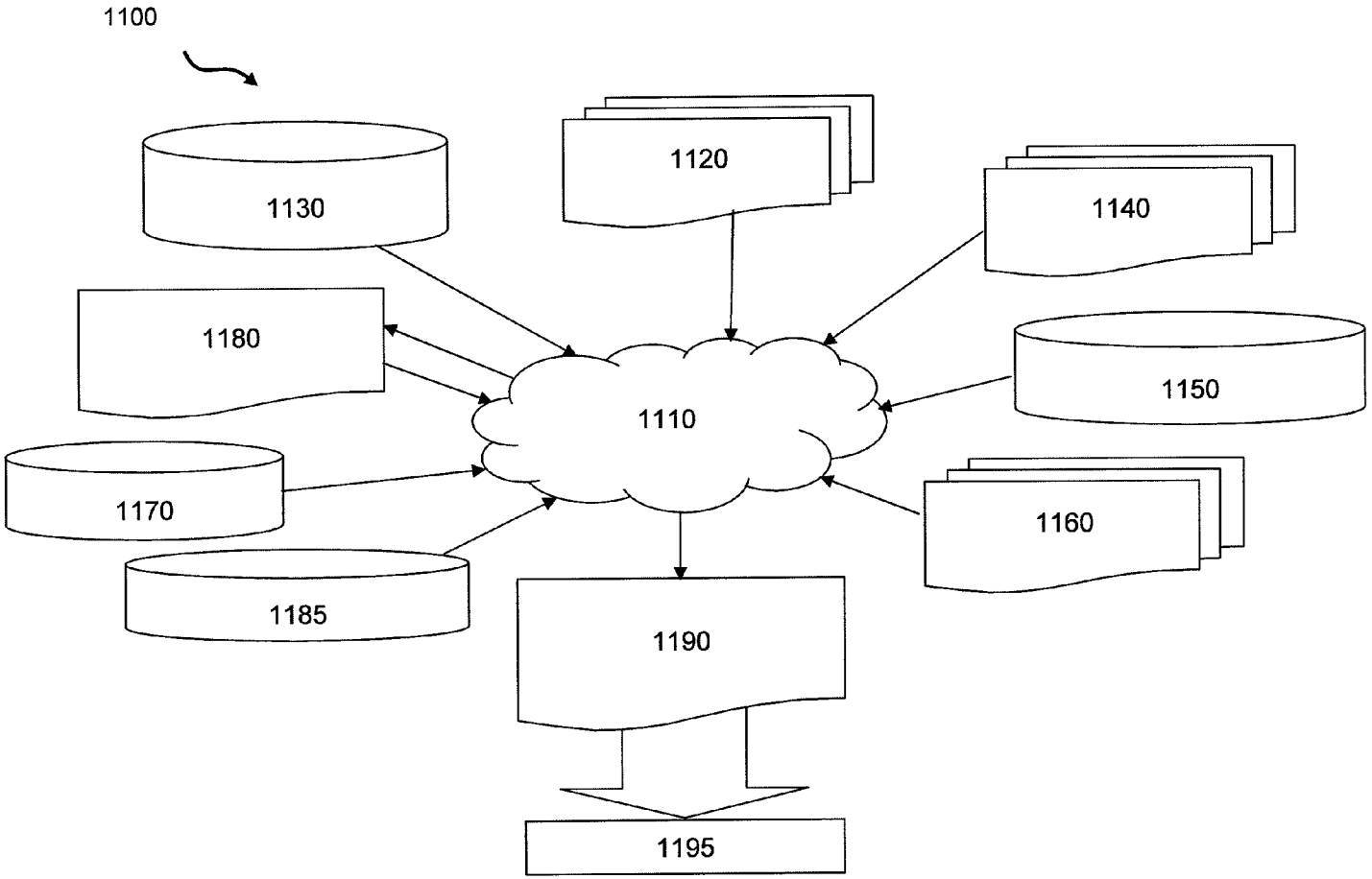
FIG. 11 is a flow diagram of a design process used in semiconductor design, manufacturing, and/or testing.

FIG. 11 shows a block diagram of an exemplary design flow 1100 used for example, in semiconductor design, manufacturing, and/or test. Design flow 1100 may vary depending on the type of IC being designed. For example, a design flow 1100 for building an application specific IC (ASIC) may differ from a design flow 1100 for designing a standard component or from a design from 1100 for instantiating the design into a programmable array, for example a programmable gate array (PGA) or a field programmable gate array (FPGA) offered by Altera® Inc. or Xilinx® Inc. (Altera is a registered trademark of Altera Corporation in the United States, other countries, or both. Xilinx is a registered trademark of Xilinx, Inc. in the United States, other countries, or both.) Design structure 1120 is preferably an input to a design process 1110 and may come from an IP provider, a core developer, or other design company or may be generated by the operator of the design flow, or from other sources. Design structure 1120 comprises an embodiment of the invention as shown in FIGS. 2, 3A, 3B, 4, 5, 7 and 8 in the form of schematics or HDL, a hardware-description language (e.g., VERILOG®, Very High Speed Integrated Circuit (VHSIC) Hardware Description Language (VHDL), C, etc.). (VERILOG is a registered trademark of Cadence Design Systems, Inc. in the United States, other countries, or both.) Design structure 1120 may be contained on one or more machine readable medium. For example, design structure 1120 may be a text file or a graphical representation of an embodiment of the invention as shown in FIGS. 2, 3A, 3B, 4, 5, 7 and 8. Design process 1110 preferably synthesizes (or translates) an embodiment of the invention as shown in FIGS. 2, 3A, 3B, 4, 5, 7 and 8 into a netlist 1180, where netlist 1180 is, for example, a list of wires, transistors, logic gates, control circuits, I/O, models, etc. that describes the connections to other elements and circuits in an integrated circuit design and recorded on at least one of machine readable medium. For example, the medium may be a CD, a compact flash, other flash memory, a packet of data to be sent via the Internet, or other networking suitable means. The synthesis may be an iterative process in which netlist 1180 is resynthesized one or more times depending on design specifications and parameters for the circuit.

Design process 1110 may include using a variety of inputs; for example, inputs from library elements 1130 which may house a set of commonly used elements, circuits, and devices, including models, layouts, and symbolic representations, for a given manufacturing technology (e.g., different technology nodes, 32 nm, 45 nm, 90 nm, etc.), design specifications 1140, characterization data 1150, verification data 1160, design rules 1170, and test data files 1185 (which may include test patterns and other testing information). Design process 1110 may further include, for example, standard circuit design processes such as timing analysis, verification, design rule checking, place and route operations, etc. One of ordinary skill in the art of integrated circuit design can appreciate the extent of possible electronic design automation tools and applications used in design process 1110 without deviating from the scope and spirit of the invention. The design structure of the invention is not limited to any specific design flow.

Design process 1110 preferably translates an embodiment of the invention as shown in FIGS. 2, 3A, 3B, 4, 5, 7 and 8, along with any additional integrated circuit design or data (if applicable), into a second design structure 1190. Design structure 1190 resides on a storage medium in a data format used for the exchange of layout data of integrated circuits and/or symbolic data format (e.g. information stored in a GDSII (GDS2), GL1, OASIS, map files, or any other suitable format for storing such design structures). Design structure 1190 may comprise information such as, for example, symbolic data, map files, test data files, design content files, manufacturing data, layout parameters, wires, levels of metal, vias, shapes, data for routing through the manufacturing line, and any other data required by a semiconductor manufacturer to produce an embodiment of the invention as shown in FIGS. 2, 3A, 3B, 4, 5, 7 and 8. Design structure 1190 may then proceed to a stage 1195 where, for example, design structure 1190: proceeds to tape-out, is released to manufacturing, is released to a mask house, is sent to another design house, is sent back to the customer, etc.

While the invention has been described in terms of embodiments, those of skill in the art will recognize that the invention can be practiced with modifications and in the spirit and scope of the appended claims.

What is claimed is:

1. A structure comprising:

an on-chip transmission line stub comprising:

a grounded structure;

a signal structure formed within the grounded structure; and a conditionally floating structure foamed within the signal structure and structured to provide increased capacitance to the on-chip transmission line stub when the conditionally floating structure is connected to ground, wherein:

the signal structure comprises a plurality of electrically connected signal elements and the conditionally floating structure comprises a plurality of electrically connected conditionally floating elements, and in a lower section of the on-chip transmission line stub, each of the plurality of electrically connected conditionally floating elements are formed adjacent to at least one of the plurality of electrically connected signal elements formed on an adjacent metal wiring layer.

2. The structure of claim 1, wherein a length of the on-chip transmission line stub is a quarter of a wavelength, which corresponds to a desired band stop frequency.

3. A structure comprising:

an on-chip transmission line stub comprising:

a grounded structure;

a signal structure formed within the grounded structure; and a conditionally floating structure formed within the signal structure and structured to provide increased capacitance to the on-chip transmission line stub when the conditionally floating structure is connected to ground wherein:

the transmission line stub further comprises:

an upper section;

a lower section; and a plurality of metal wiring layers in the upper section and the lower section, the grounded structure comprises a first portion of each metal wiring layer, in the upper section, the signal structure comprises a second portion of each metal wiring layer and in the lower section, the signal structure comprises a third portion and a fourth portion of alternating metal wiring layers, respectively, and in the upper section, the conditionally floating structure comprises a fifth portion of each metal wiring layer and in the lower section, and the conditionally floating structure comprises a sixth portion of alternating metal wiring layers between the fourth portion of a same wiring layer and adjacent the third portions of adjacent metal wiring layers.

4. The structure of claim 3, wherein when the conditionally floating section is connected to ground, the on-chip transmission line stub realizes the increased capacitance between the sixth portion of the alternating metal wiring layers and the third portions of the adjacent metal wiring layers, wherein the increased capacitance increases propagation delay in a signal passing on the signal structure.

5. The structure of claim 3, wherein a first spacing between the grounded structure and the signal structure in the upper section is larger than a second spacing between the grounded structure and the signal structure in the lower section.

6. The structure of claim 3, wherein the upper section comprises metal wiring layers which are thicker than metal wiring layers of the lower section.

7. The structure of claim 1, wherein the grounded structure comprises a ring structure formed around the signal structure and the conditionally floating structure.

8. The structure of claim 1, wherein the signal structure comprises a ring structure formed around the conditionally floating structure.

9. The structure of claim 1, further comprising a switch to selectively couple the conditionally floating structure to the grounded structure.

10. The structure of claim 9, wherein the switch comprises at least one of a field effect transistor (FET) and an on-chip diode.

11. The structure of claim 1, wherein the conditionally floating structure comprises a plurality of discrete conditionally floating structure sections connected to a common electrical node and structured and arranged to reduce an impact of inductance on the structure.

12. The structure of claim 1, further comprising a transmission line between an input port and an output port, wherein the on-chip transmission line stub is arranged orthogonally to the transmission line.

13. The structure of claim 1, wherein when the conditionally floating structure remains floating the on-chip transmission line stub provides a stop band frequency and when the conditionally floating structure is grounded the increased capacitance effectively lowers the stop band frequency.

14. A method comprising:

forming in a substrate an on-chip transmission line stub comprising foaming a conditionally floating structure structured to provide increased capacitance to the on-chip transmission line stub when the conditionally floating structure is connected to ground;

forming a plurality of metal wiring layers in the substrate in an upper section and a lower section of the on-chip transmission line stub;

forming a grounded structure with a first portion of each metal wiring layer;

forming a signal structure in the upper section with a second portion of each metal wiring layer; and forming the signal structure in the lower section with a third portion and a fourth portion of alternating metal wiring layers, respectively, wherein in the upper section, the conditionally floating structure is formed with a fifth portion of each metal wiring layer and in the lower section, the conditionally floating structure is formed with a sixth portion of alternating metal wiring layers between the fourth portion of a same wiring layer and adjacent the third portions of adjacent metal wiring layers.

15. The method of claim 14, wherein the signal structure is formed within the grounded structure and the conditionally floating structure is formed within the signal structure and the conditionally floating structure is capacitively shielded from ground by the signal structure.

16. The method of claim 15, further comprising providing a switch to selectively couple the conditionally floating structure to the grounded structure, wherein the switch comprises at least one of a field effect transistor (FET) switch and an on-chip diode switch.

17. A method comprising:

forming in a substrate an on-chip transmission line stub comprising forming a conditionally floating structure structured to provide increased capacitance to the on-chip transmission line stub when the conditionally floating structure is connected to ground;

forming a grounded structure; and forming a signal structure, wherein:

the signal structure is formed with a plurality of electrically connected signal elements and the conditionally floating structure is formed with a plurality of electrically connected conditionally floating elements, and in a lower section of the transmission line stub, each of the plurality of electrically connected conditionally floating elements are formed adjacent at least one of the plurality of electrically connected signal elements on an adjacent wiring layer.

18. The method of claim 14, wherein the conditionally floating structure is formed with a plurality of discrete conditionally floating structure sections connected to a common electrical node and structured and arranged to reduce any impact of inductance on the structure.

* * * * *